United States Patent [19]

Cucksee et al.

[11] 4,070,213

[45] Jan. 24, 1978

[54] DISPERSING AIDS FOR MT-4

[75] Inventors: Marjorie T. Cucksee, Huntsville; Henry C. Allen, Decatur, both of Ala.

[73] Assignee: The United States of America as represented by the Secretary of the Army, Washington, D.C.

[21] Appl. No.: 701,319

[22] Filed: June 30, 1976

[51] Int. Cl.[2] ..... C06B 45/10

[52] U.S. Cl. ..... 149/19.92; 149/19.4;19.9

[58] Field of Search ..... 149/19.4, 19.9, 19.92

[56] References Cited

U.S. PATENT DOCUMENTS

| | | | |
|---|---|---|---|
| 3,695,952 | 10/1972 | Allen | 149/19.9 |
| 3,762,972 | 10/1973 | Allen | 149/19.9 |
| 3,801,385 | 4/1974 | Mastralia et al. | 149/19.9 |
| 3,953,260 | 4/1976 | Braun et al. | 149/19.9 |
| 3,986,906 | 10/1976 | Sayles | 149/19.9 |

*Primary Examiner*—Edward A. Miller

*Attorney, Agent, or Firm*—Nathan Edelberg; Robert P. Gibson; Jack W. Voigt

[57] ABSTRACT

Diols of the general formula, $R(OH)_2$, wherein R is an alkylene radical, and iminodiols of the general formula, $R'N(R''OH)_2$, wherein R′ is an aryl or alkyl radical and R″ is an alkylene radical, with melting points of less than 60° C (140° F) are effective dispersing aids for the bonding agent MT-4. MT-4 which functions as an interfacial bonding agent is prepared by reacting together 2.0 moles of tris 1(2 methylaziridinyl)phosphine oxide, 0.7 mole adipic acid, and 0.3 mole tartaric acid. The specified dispersing aids react to become a part of the binder matrix without causing degradation of physical properties or nullification of the functions of MT-4. The specified dispersing aids for the bonding agent MT-4 were found to be particularly effective to ensure uniform coating of solids in solid propellants employing a hydroxy-terminated polybutadiene binder system while not imparting negative side effects that the dispersing adjuvant of "added" water causes.

3 Claims, No Drawings

DISPERSING AIDS FOR MT-4

DEDICATORY CLAUSE

The invention described herein may be manufactured, used, and licensed by or for the Government for governmental purposes without the payment to us of any royalties thereon.

BACKGROUND OF THE INVENTION

Solid propellant grains are required to be of uniform composition and to have good physical, chemical, and mechanical properties over a wide temperature range since the environmental conditions that solid propellant grains may be subjected to between the manufacturing date and the date used in a solid propellant rocket motor can vary considerably.

As the state-of-the-art has progressed in solid propellants various additives and processing aids to enhance properties or to improve processing conditions have been required. MT-4 is one such development which enhanced the mechanical properties when added to the propellant composition during the mixing thereof, in a trace amount from about 0.05 to about 0.5 weight percent of the propellant composition. The MT-4 serves as an interfacial bonding agent between the binder ingredients and the solid ingredients which include fine ammonium perchlorate, aluminum powder fuel, and optional additives. Although MT-4 improved the mechanical properties, it was found that a dispersing aid for the MT-4 was found to be necessary to ensure uniform coating of solids in the hydroxy-terminated polybutadiene binder system. Inadequate dispersion of MT-4 caused degradation of physical and mechanical properties and caused nullification of the function of MT-4 at low temperature.

Prior art dispersion adjuvants included trace amounts of "added" (to the MT-4) water, approximately 0.03% water based on propellant weight. Physical and mechanical property data confirmed that some of the curing agent was consumed by "added" water. The data also showed evidence when excessive amounts of "added" water is used that the bond at the AP interface is weakened and dewetting occurred at low temperature.

Desirable would be a dispersion aid for MT-4 which would react to become a part of the binder matrix without causing degradation of physical properties or nullification of the functions of MT-4 at low temperatures.

Therefore, an object of this invention is to provide a dispersion aid for MT-4 to ensure uniform coating of solids in a hydroxy-terminated polybutadiene bound solid propellant composition.

Another object of this invention is to provide a dispersing aid for MT-4 that enhances the propellant physical and mechanical properties by reacting to become a part of the binder matrix.

SUMMARY OF THE INVENTION

A diol selected from a diol having the general formula $R(OH)_2$, wherein R is an alkylene radical, or an iminodiol selected from an iminodiol having the general formula $R'N(R''OH)_2$, wherein R' is aryl or alkyl radical and R'' is an alkylene radical, when incorporated in an amount from about 0.01 weight percent to about 0.1 weight percent of a composite propellant composition is an effective dispersing aid for MT4, a bonding agent prepared by reacting together 2.0 moles of tris 1(2 methylaziridinyl)phosphine oxide, 0.7 mole adipic acid, and 0.3 mole tartaric acid.

The dispersing aid reacts to become a part of the binder matrix without causing degradation of physical properties or nullification of the functions of MT-4 in the composite propellant composition. The representive composite propellant composition is comprised of the solids which include an ammonium perchlorate oxidizer blend of 200 micron and 17 micron particle size, aluminum metal fuel, and $Fe_2O_3$ catalyst along with a binder of hydroxy-terminated polybutadiene, a plasticizer selected from a hydrocarbon plasticizer and an ester plasticizer, such as isodecyl pelargonate or diethyleneglycol dinitrate, a diisocyanate curing agent, and the selected dispersing aid.

DESCRIPTION OF THE PREFERRED EMBODIMENT

Ethylene glycol ($ET(OH)_2$) is representative of a diol of the general formula $R(OH)_2$, wherein R is an alkylene radical, and 2, 2' benzylimino diethanol (BIDE) is representative of an iminodiol having the general formula $R'N(R''OH)_2$, wherein R' is aryl or alkyl radical and R'' is an alkylene radical, which diol or iminodiol serves as a dispersing aid for MT-4 in a composite propellant composition.

A preferred procedure for incorporating the MT-4 with the dispersing aid into the propellant composition is as follows:

Procedure for Adding MT-4 and Dispersing Aid

1. Reserve a quantity of polymer (HTPB) for diluting MT-4 and dispersing aid blend.
2. Weigh out the required amount of MT-4 (0.05%-0.5% by weight of propellant composition).
3. Weigh out the required amount of dispersing aid (0.01%-0.1% by weight of propellant composition).
4. Add dispersing aid to MT-4.
5. Add an amount of polymer (HTPB) which is about 3 times the weight of MT-4 in step 2 to the MT-4 and dispersing aid blend to dilute the blend and facilitate the mixing in the propellant composition.
6. Add the remaining polymer and the polymer-MT-4-dispersing aid blend to the propellant composition mix and continue mixing until uniformly distributed in mix.

The data set forth under Example below illustrate prior art propellant samples No. 2 and 5 with 0.02% and 0.05% "added" water respectively as a dispersing aid for MT-4 as compared with the same prior art propellant formulation as No. 1 with no dispersing aid added. The Example also illustrates propellant sample No. 3 with 0.05% BIDE as the dispersing aid and propellant sample No. 4 with 0.03% $ET(OH)_2$ (ethylene glycol) as the dispersing aid. The physical and mechanical properties data clearly shows that the dispersing aid is effective in improving these properties while not interfering with the functions of MT-4 and pot life of the propellant composition.

EXAMPLE

| No. | Variable* | Composition Pot Life** (hrs) at 140° F | Stress (at −40° F) psi | % Strain (at −40° F) max stress/break |
|---|---|---|---|---|
| 1 | No dispersing aid | 1 1/10 | 321 | 8/53 |
| 2 | MT4 + $H_2O$ | 9 | 334 | 54/71 |
| 3 | MT4 + BIDE (0.05 Wt. %) | 7 | 368 | 48.2/55.3 |
| 4 | MT4 + $ET(OH)_2$ (0.03 Wt. %) | 8 | 327 | 50.4/59.4 |
| 5 | MT4 + $H_2O$ (0.05 Wt. %) | 12 3/4 | 306 | 8/62 |

*The basic composition was a typical hydroxy-terminated polybutadiene (HTPB) composite propellant formulation containing aluminum metal fuel, $Fe_2O_3$ catalyst, and a blend of 200 micron and 17 micron particle size ammonium perchlorate as the solids. The binder was comprised of HTPB, a plasticizer selected from a hydrocarbon plasticizer (e.g. Circo light oil or similar hydrocarbon processing oils), an ester type plasticizer, such as isodecyl pelargonate or ester type energetic plasticizer, such as diethyleneglycol dinitrate (DEGDN), triethyleneglycol dinitrate (TEGDN), etc., a diisocyanate curing agent, MT4 bonding agent, and a dispersing aid.

**Defined as time in hours for viscosity to increase to 40 $k_p$

The Enstron traces for compositions 1 and 5 were very regressive which is indicative of dewetting between binder and filler. The low strain at max stress and very short pot life of composition 1 shows that the MT-4 did not adequately coat the AP surfaces. The low strain at max stress and long pot life of composition 5 shows that even though the AP was adequately coated, the coating was "softened", the bond between AP and bonding agent shell destroyed by the excess water. This resultant problem is one of the major inherent dangers in the use of water as a dispersing aid. This problem does not occur with the dispersing aids such as BIDE and $ET(OH)_2$ because they are difunctional and react to become a part of the bonding agent shell or the binder. They provide no species which would soften the bonding agent shell.

The diols or iminodiols with melting points of less than 60° C (140° F) have been demonstrated to be effective dispersing aids for MT-4 in hydroxy-terminated polybutadiene without the negative side effects of water. The negative side effects of water include weakening the bond at the AP interface, consuming some of the curing agent, and a degradation of physical properties of the propellant due to dewetting particularly which occurs at low temperatures.

The melting point, upper limit, of the diols and iminodiols used as dispersing aids is preferred to be less than 140° F since this is the generally used processing temperature for propellant mixing. Better dispersing action to insure that the uniform coating takes place is accomplished when the diols or iminodiols melting points are below the processing temperatures. If a higher temperature is used for processing some propellant formulations then additional diols or iminodiols (with higher melting points) can be selected for use.

We claim:

1. In a method relating to processing a solid propellant composition wherein an interfacial bonding agent which is the product prepared by reacting together 2.0 moles of tris 1(2 methylaziridinyl) phosphine oxide, 0.7 mole adipic acid, and 0.3 mole tartaric acid is employed to improve the bond between the binder ingredients of a solid propellant composition comprised of a binder of a hydroxy-terminated polybutadiene, a plasticizer selected from the group consisting of a hydrocarbon processing oil plasticizer, a nonenergetic ester plasticizer, or an energetic ester plasticizer, a diisocyanate curing agent, a burning rate catalyst of $Fe_2O_3$, and an ammonium perchlorate oxidizer blend of 200 micron and 17 micron particle size, the additional improvement to said processing method which enhances the physical and mechanical properties of said propellant composition when cured achieved by incorporating from about 0.01 weight percent to about 0.1 weight percent of said composition a dispersing aid for said interfacial bonding agent selected from a diol having the general formula, $R(OH)_2$, wherein R is an alkylene radical, or an iminodiol selected from an iminodiol having the general formula $R'N(R''OH)_2$, wherein R' is an aryl or alkyl radical and R'' is an alkylene radical, said selected diol or iminodiol being an effective dispersing aid for said interfacial bonding agent which results in improving the efficiency of said interfacial bonding agent by ensuring uniform coating of solids; and said selected diol or iminodiol being reactive to become a part of the binder matrix without causing degradation of the physical and mechanical properties as a result of dewetting or weakening of the bond at the ammonium perchlorate interface of said solid propellant composition.

2. The additional improvement to said processing method as set forth in claim 1 wherein said dispersing aid selected has the general formula $R(OH)_2$, wherein said alkylene radical is $C_2H_4$, and wherein said dispersing aid is ethylene glycol which is incorporated in said solid propellant composition in an amount of about 0.03 weight percent of said solid propellant composition.

3. The additional improvement to said processing method as set forth in claim 1 wherein said dispersing aid selected has the general formula $R'N(R''OH)_2$, wherein said alkylene radical is $C_2H_4$, and wherein said dispersing aid is 2,2' benzyl-imino diethanol which is incorporated in said solid propellant composition in an amount of about 0.05 weight percent of said solid propellant composition.

* * * * *